US008549890B2

(12) United States Patent
Klintenstedt et al.

(10) Patent No.: US 8,549,890 B2
(45) Date of Patent: Oct. 8, 2013

(54) METHOD AND A PRESS TOOL FOR MANUFACTURING A SEPARATION DISK

(75) Inventors: Kjel Klintenstedt, Saltsjö-Boo (SE); Sven Olov Olsson, Huddinge (SE); Lars Johan Rudman, Farsta (SE)

(73) Assignee: Alfa Laval Corporate AB, Lund (SE)

( * ) Notice: Subject to any disclaimer, the term of this patent is extended or adjusted under 35 U.S.C. 154(b) by 254 days.

(21) Appl. No.: 13/121,740

(22) PCT Filed: Sep. 30, 2009

(86) PCT No.: PCT/SE2009/051086

§ 371 (c)(1), (2), (4) Date: Apr. 27, 2011

(87) PCT Pub. No.: WO2010/039098

PCT Pub. Date: Apr. 8, 2010

(65) Prior Publication Data

US 2011/0209513 A1 Sep. 1, 2011

(30) Foreign Application Priority Data

Sep. 30, 2008 (SE) ..... 0802061

(51) Int. Cl.
*B21D 22/28* (2006.01)

(52) U.S. Cl.
USPC ..... 72/329; 72/349; 72/354.6; 72/359; 494/68; 494/70

(58) Field of Classification Search
USPC ..... 72/69, 82, 83, 84, 85, 342.94, 354, 72/359, 700, 342.1, 354.6; 494/68, 70, 71, 494/73, 75
See application file for complete search history.

(56) References Cited

U.S. PATENT DOCUMENTS

| | | | | |
|---|---|---|---|---|
| 1,006,622 | A | 10/1911 | Bailey | |
| 1,919,287 | A * | 7/1933 | Auble | 72/329 |
| 2,118,018 | A * | 5/1938 | Swanson | 72/463 |
| 3,409,521 | A * | 11/1968 | Sharples | 494/73 |
| 3,668,917 | A * | 6/1972 | Komatsu et al. | 72/342.3 |
| 4,356,717 | A * | 11/1982 | Okunishi et al. | 72/342.3 |
| 4,770,283 | A * | 9/1988 | Putz et al. | 72/359 |
| 5,687,600 | A * | 11/1997 | Emigh et al. | 72/69 |
| 6,457,340 | B1 | 10/2002 | Kanemitsu et al. | |
| 6,526,794 | B1 * | 3/2003 | Langer et al. | 72/69 |
| 2008/0184763 | A1 | 8/2008 | Schroth et al. | |

FOREIGN PATENT DOCUMENTS

| | | | |
|---|---|---|---|
| EP | 1136149 | A2 | 9/2001 |
| WO | 2007055630 | A1 | 5/2007 |

OTHER PUBLICATIONS

International Preliminary Report on Patentability for PCT/SE2009/051086, dated Apr. 5, 2011.

* cited by examiner

*Primary Examiner* — David B Jones
(74) *Attorney, Agent, or Firm* — MKG, LLC

(57) ABSTRACT

The invention refers to a method and a press tool for manufacturing a separating disk adapted to be included in a disk package of a centrifuge rotor of a centrifugal separator. The separating disk extends around an axis of rotation and has a tapering shape with an inner surface and an outer surface along the axis of rotation. A blank of a material is provided. A central opening is made in the blank. The blank is positioned in a charging position by means of a projecting central portion. The blank is pressed against the first tool part having a shape corresponding to the tapering shape of the separating disk.

16 Claims, 12 Drawing Sheets

METHOD AND A PRESS TOOL FOR MANUFACTURING A SEPARATION DISK

FIELD OF THE INVENTION

The present invention refers to a method for manufacturing a separating disk adapted to be included in a disk package of a centrifuge rotor of a centrifugal separator. The invention also refers to a press tool for manufacturing a separating disk adapted to be included in a disk package for a centrifuge rotor of a centrifugal separator.

BACKGROUND

Today separating disks for disk packages in centrifuge rotors are normally manufactured through pressure turning of plane disks to a desired tapering shape, for instance a conical shape. This method of manufacturing has the disadvantage that the manufacturing is expensive and time-consuming. Each separating disk has to be pressure turned individually in a pressure lathe. Another disadvantage of the pressure turning method is that it is difficult to produce irregular shapes such as protrusions in the pressure turned disk. A further disadvantage of the pressure turning method is the difficulty to achieve a sufficient surface smoothness without subsequent treatment of the surface. A poor surface smoothness can lead to deteriorated hygienic properties.

SUMMARY OF THE INVENTION

One object of the present invention is to provide a method and a tool for manufacturing a separating disk, which has a high and uniform quality and which can be manufactured to a low cost.

The present invention resides in one aspect is a method for manufacturing a separation dish wherein a blank of a material is provided. A central opening in molded in the blank, the blank is positioned in a charging position by means of a projecting central portion, and the blank is pressed against a first tool part having a shape corresponding to the tapering shape of the separating disk.

By means of such a method, separating disks can be manufactured in an easy and efficient manner. Thanks to the central opening being made before the pressing proper and the positioning of the blank by means of the projecting central portion, the material of the blank is distributed in a substantially uniform manner inwardly and outwardly.

The separating disk may thus obtain a relatively uniform thickness from an inner edge to an outer edge. Advantageously, the projecting central portion may extend through and engage the central opening of the blank. In such a way, it is possible to control the flow of material, at least during an initial phase of the press step, with regard to how much material is to be taken from the centre and the peripheral parts, respectively, of the blank during the press step.

According to a further aspect of the present invention, the press step comprises forming an area around the central opening in such a way that the material in this area forms a centering member, which at least partly extends cylindrically and concentrically with the axis of rotation. Such a centering member is advantageous, for instance in a subsequent processing operation when centering of the pressed blank may be necessary essential.

According to another aspect of the present invention, the press step comprises a first part step where the blank by means of a second tool part is pressed in a direction towards the first tool part in such a way that said centering member is formed and that a sealing element of the second tool part abuts sealingly the blank around the central opening. Furthermore, the press step may also comprise a second part step where a liquid is supplied at a pressure between the blank and the second tool part in such a way that the blank is pressed to abutment against the first tool part. The second press step, which relies on a hydroforming principal, permits an advantageous forming of the material so that this in a uniform manner is distributed to abutment against the first tool part comprising form elements for forming of said protrusions.

According to a further aspect of the method, the second part step comprises evacuation of gas present between the blank and the first tool part. In such a way a tight abutment against the first tool part can be achieved.

According to a further development of the method, the press step comprises forming a plurality of protrusions extending from the inner surface and/or outer surface, wherein the first tool part comprises first form elements having a shape which also corresponds to the shape of the protrusions. In such a way, the shape and possible distance members of the separating disk may be provided in an easy and efficient manner in one single press operation.

According to a further aspect of the method, the method comprises at least a subsequent processing step for forming of an inner edge, which delimits a central opening of the separating disk, and an outer edge. Advantageously, the processing step may be preceded by a centering of the separating disk by means of said centering member in a processing machine before the processing step is performed.

According to a further aspect of the method, the processing step comprises forming of one or several recesses along the inner edge and/or the forming of one or several recesses along the outer edge. Said recess may be arranged to permit polar-positioning of the separating disk in the disk package.

According to a further aspect of the method, the first tool part has a concave shape against which the outer surface of the separating disk abuts. Alternatively, it is however possible to let the first tool part have a convex shape against which the inner surface of the separating disk abuts.

The present invention also resides in a press tool initially wherein a first tool part has a shape corresponding to the tapering shape of the pressed separating disk and that the second tool part has a projecting central portion arranged to extend through the central opening of the blank in the charging position. By means of such tool, which can be adapted for performing the above-mentioned method, separating disks can be manufactured in an easy and efficient manner. Thanks to the projecting central portion extending through the central opening, the blank is positioned during an initial phase of the pressing. In such a way, the flow material may be controlled so that a uniform distribution is achieved for the whole separating disk, i.e. the separating disk obtains a uniform thickness. This control possibility may also be used to create various thicknesses of the separating disk if so desired, for instance a deviating thickness in the proximity of the inner or outer edge.

According to an embodiment of the present invention, the first and second tool parts have a respective form element which in co-operation with each other are arranged, when the first and second tool parts have been moved to the final position, to form an area around the central opening in such a way that the material in this area forms a centering member which at least partly extends cylindrically and concentrically with the axis of rotation.

According to a further embodiment of the invention, the second tool part has a sealing element, which is provided radially outside the projecting central portion and extends around the latter, and which is arranged to abut sealingly the blank around the central opening.

According to a further embodiment of the present invention, the press tool comprises a supply device arranged to permit, in a final position, supply of a liquid at a pressure between the blank and the second tool part in such a way that the blank is pressed into abutment against the first tool part.

According to a further embodiment of the present invention, the first tool part comprises first form elements which are arranged to provide a number of distance members of the separating disk in form of pressed protrusions extending away from the inner surface and/or the outer surface.

According to a further embodiment of the present invention, the first tool part comprises evacuating passages for evacuation of gas present between the blank and the first tool part.

BRIEF DESCRIPTION OF THE DRAWINGS

The invention is now to be explained through a description of various embodiments and with reference to the drawings attached hereto.

DETAILED DESCRIPTION OF VARIOUS EMBODIMENTS OF THE INVENTION

Figure 1:
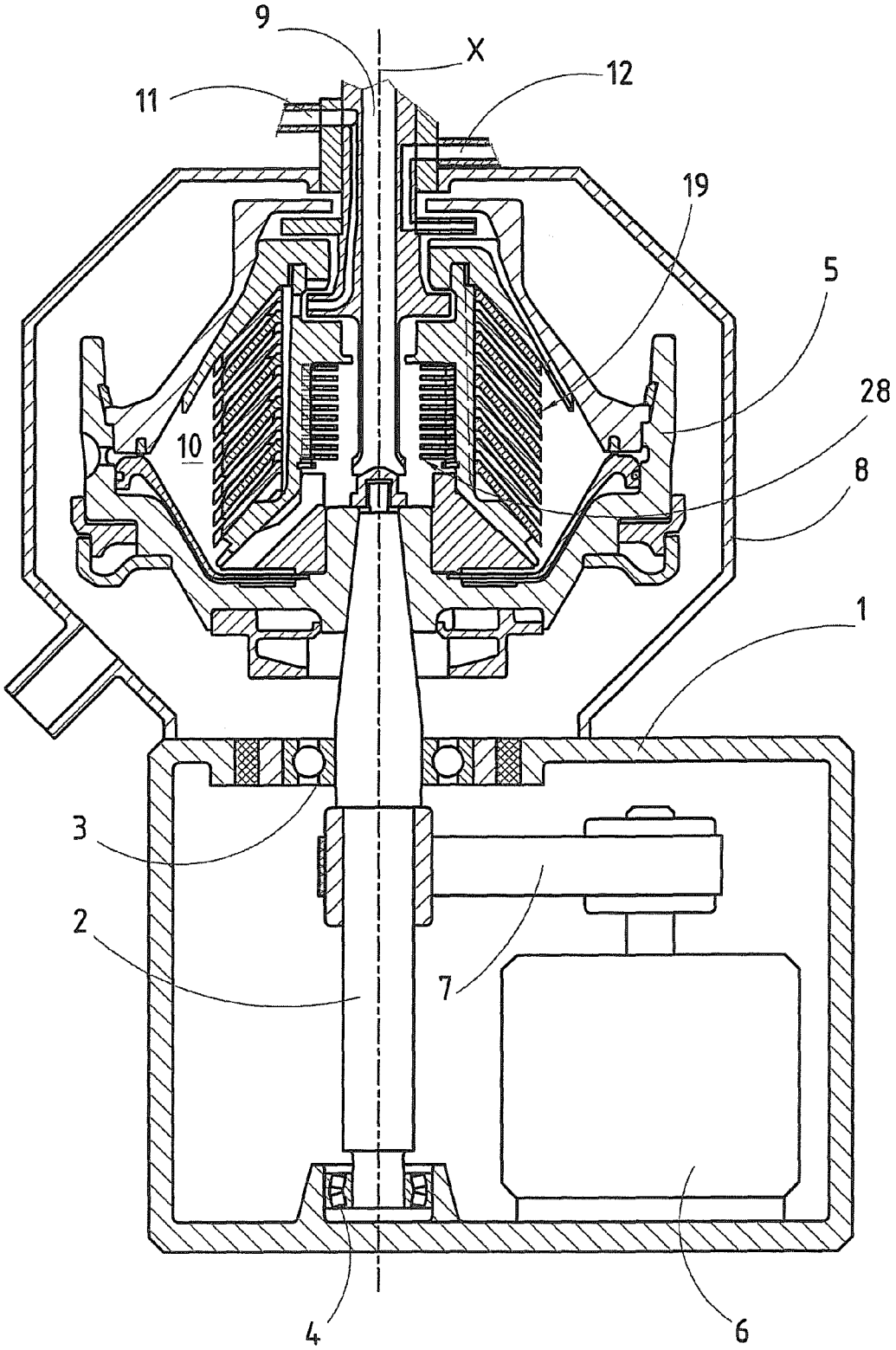
FIG. 1 discloses a partly sectional side view of a centrifugal separator with a centrifuge rotor.

FIG. 1 discloses a centrifugal separator which is adapted for separation of at least a first component and a second component of a supplied medium. It is to be noted that the disclosed centrifugal separator is disclosed as an example and that the configuration thereof may be varied. The centrifugal separator comprises a frame 1, which may be non-rotatable or stationary, and a spindle 2 which is rotably journalled in an upper bearing 3 and a lower bearing 4. The spindle 2 carries a centrifuge rotor 5 and is arranged to rotate together with the centrifuge rotor 5 around an axis x of rotation in relation to the frame 1. The spindle 2 is driven by means of a drive member 6 which is connected to the spindle 2 in a suitable manner in order to rotate the latter at a high velocity, for instance via a drive belt 7 or a gear transmission, or through direct drive, i.e. the rotor (not disclosed) of the drive member 6 is directly connected to the spindle 2 or the centrifuge rotor 5. It is to be noted here that elements having the same function has been provided with identical reference signs in the various embodiments to be described.

The centrifugal separator may comprise a casing 8 which is connected to the frame 1 and which encloses the centrifuge rotor 5. Furthermore, the centrifugal separator comprises at least one inlet 9, which extends through the casing 8 and into a separation space 10 which is formed by the centrifuge rotor 5 for feeding of the medium to be centrifuged, and at least a first outlet for discharged from the separation space 10 of the first component which has been separated from the medium and a second outlet for discharge from the separation space 10 of the second component which has been separated from the medium.

In the separation space 10, there is a disk package 19 which rotates with the centrifuge rotor 5. The disk package 19 comprises or is assembled of a plurality of separating disks 20 which are piled onto each other in the disk package 19, see FIG. 2. A separating disk 20 according to a first embodiment is disclosed more closely in FIGS. 3 and 4. Each separating disk 20 extends around the axis x of rotation and rotates around the axis x of rotation in a direction R of rotation. Each separating disk 20 extends along a rotary symmetric, or virtually rotary symmetric, surface which tapers along the axis x of rotation, and has a tapering shape along the axis x of rotation with an outer surface 21, which is convex, and an inner surface 22, which is concave. The tapering shape of the separating disks 20 may also be conical or substantially conical, but it is also possible to let the tapering shape of the separating disks 20 have a generatrix which is curved inwardly or outwardly. The separating disks 20 thus have an angle $\alpha$ of inclination in relation to the axis x of rotation, see FIG. 2. The angle $\alpha$ of inclination may be 20-70°. Each separating disk 20 also has an outer edge 23 along the radially outer periphery of the separating disk 20 and an inner edge 24 which extends along the radially inner periphery of the separating disk 20 and defines a central opening of the separating disk 20.

Figure 5:
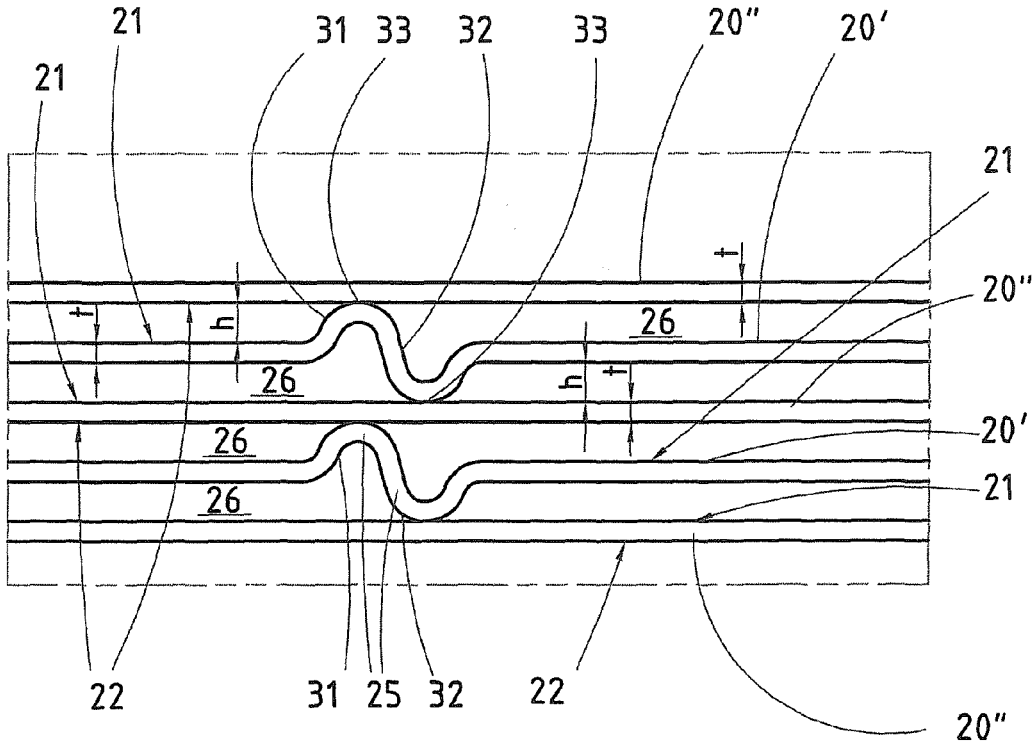
FIG. 5 discloses a section through the disk package in FIG. 2.

Between the separating disks 20, there are distance members 25 which are provided on the outer surface 21 and/or the inner surface 22 and arranged to form an interspace 26 between adjacent separating disks 20 in the disk package 19, see FIG. 5. Each separating disk 20 comprises at least one portion without distance members 25 on the outer surface 21 and/or the inner surface 22. The separating disks 20 may be provided around a so called distributor 27. The separating disks 20 are compressed against each other in the disk package 19 with a pre-tensioning force in such a way that the distance members 25 of a separating disk abuts sealingly an adjacent separating disk 20, especially against the above mention portion of an adjacent separating disk 20. The separating disks 20 may also be fixedly connected to each other, for instance through brazing.

Figure 2:
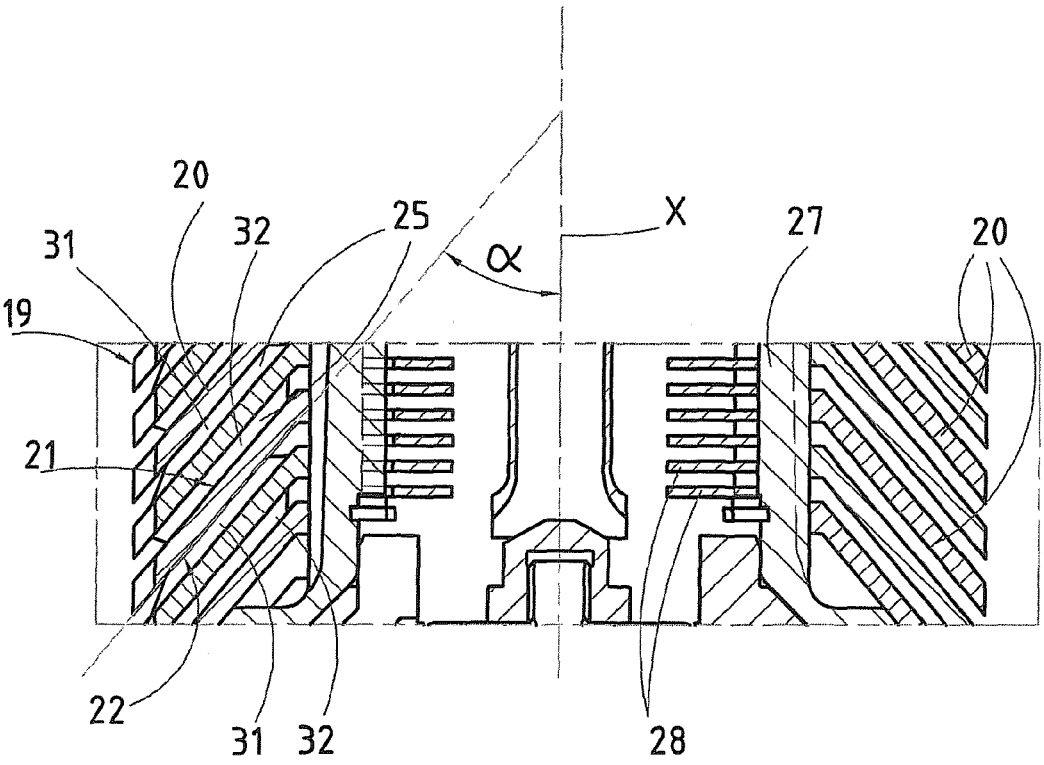
FIG. 2 discloses a sectional side view through a disk package of the centrifugal separator in FIG. 1.

As can be seen in FIGS. 1 and 2, the centrifuge rotor 5 also comprises a number of inlet disks 28 which are centrally provided in the distributor 27. These inlet disks 28 may be manufactured in a similar manner as the separating disks 20. The inlet disks 28 may be plane, as disclosed in FIGS. 1 and 2, or conical. The inlet disks 28 may have distance members with a similar configuration as the distance members 25 of the separating disks 20.

The tapering shape of the separating disks 20 has been provided through pressing of a blank of a material against a tool part. The material may be any pressable material, for instance metal material, such as steel, aluminium, titanium, various alloys etc., and also suitable plastic materials. The tool part to be described more closely below has a shape corresponding to the tapering shape of the pressed separating disk 20. It is to be noted, however, that the separating disks 20 as a consequence of such a pressing may obtain a thickness t that varies with the distance from the axis x of rotation.

Figure 4:
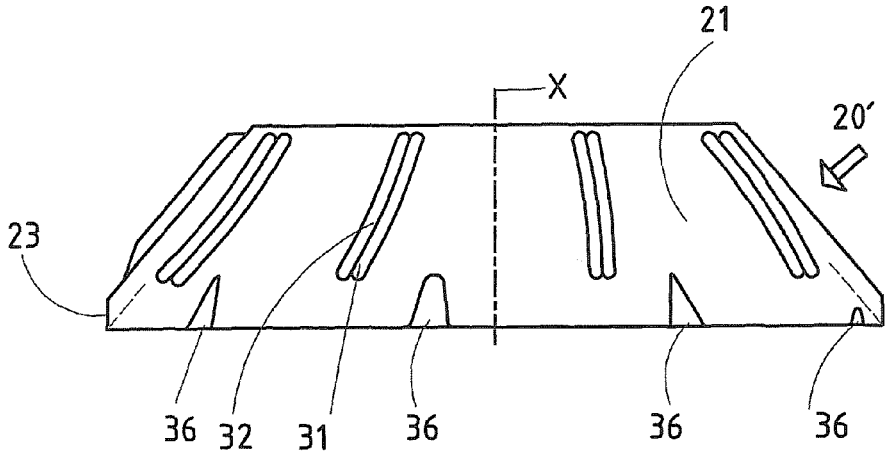
FIG. 4 discloses a side view of the separating disk in FIG. 3.
Figure 3:
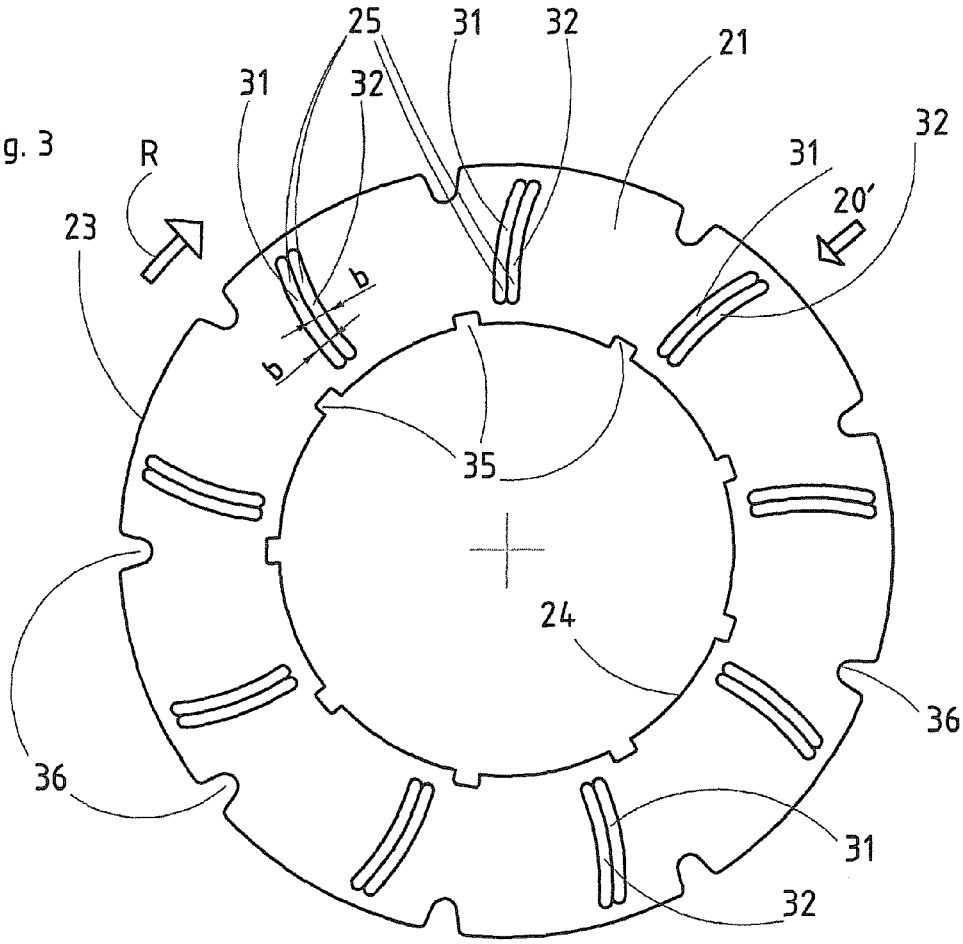
FIG. 3 discloses a view from above of a separating disk of the disk package according to a first embodiment.

In the first embodiment disclosed more closely in FIGS. 3-5, the distance members 25 are formed as protrusions in the material, wherein the tapering shape and the protrusions of the separating disk 20 have been produced through pressing of the blank against the tool part having a shape corresponding to the tapering shape with the protrusions of the pressed separating disk 20. In the first embodiment the distance members 25 comprise first distance members 25 in the form of first protrusions 31 and second distance members 25 in the form of second protrusions 32. The protrusions thus comprise a number of pairs of protrusions, wherein each of the pairs comprises a first protrusion 31 extending away from the outer surface 21 and a second protrusion 32 extending away from the inner surface 22. The first and second protrusions 31, 32 are displaced in relation to each other seen in a normal direction with regard to the outer surface 21. In the embodiment disclosed, the first and second protrusions 31, 32 are provided adjacent, or directly adjacent, to each other in a peripheral direction of the separating disk 20. It is possible to provide the distance members 25, i.e. in the embodiments disclosed the first and second protrusions 31, 32, in each pair at a significant distance from each other, for instance in such a way that a first protrusion 31 is located at the centre between two second protrusions 32. Possibly, the protrusions 31, 32 may then be given a more wide shape and in an extreme case extend substantially straight from the peak of a first protrusion 31 to the peak of the adjacent second protrusions 32, which means that there is no marked beginning or marked end of the distance members 25.

As can be seen in FIG. 5, the first protrusion 31 abuts the inner surface 22 of the adjacent separating disk 20, whereas the second protrusion 32 abuts the outer surface 21 of an adjacent separating disk 20. The first protrusion 31 will thus form a channel-like depression of the inner surface 22 and this depression is configured to collect and transport one of said components radially outwardly or inwardly on the inner surface 22. The second protrusion 32 forms, in a corresponding manner, a channel-like depression of the outer surface 21, wherein this depression is configured to collect and transport one of said components radially outwardly or inwardly on the outer surface 21. In the first embodiment, the second protrusion 32 is located after the first protrusion 31 with regard to the direction R of rotation. With regard to the outer surface 21, the channel-like depression thus precedes the upwardly projecting first protrusion 31. With regard to the inner surface 22, the channel-like depression instead follows the downwardly projecting second protrusion 32. Inverted relations arise if the direction of rotation is the opposite.

The first and second protrusions 31 and 32 have a height h above the outer surface 21 and the inner surface 22, respectively, see FIG. 5. This height h determines also the height of the interspaces 26 between the separating disks 20 in the disk package 19. Since the thickness t of the separating disks 20 may vary with the distance from the axis x of rotation, the first and second protrusions 31 and 32 may advantageously be configured in such a way that the height h varies with the distance from the axis x of rotation. As can be seen in FIG. 3, the distance members 25, i.e. the first and second protrusions 31 and 32, have an extension from a radially inner position to a radially outer position, wherein the height h varies along this extension in such a way that this varying height compensates for the varying thickness. In such a way a tight and uniform abutment between the first and second protrusions 31 and 32 against the inner surface 22 and the outer surface 21, respectively, can be achieved along the whole or substantially the whole extension of the protrusions 31, 32.

Depending on the actual press method, the thickness t of the separating disk 20 may increase with an increasing distance from the axis of rotation, wherein the height h decreases with an increasing distance from the axis x of rotation. The thickness t of the separating disk 20 may also decrease with an increasing distance from the axis x of rotation, wherein the height of the distance members 25 increases with an increasing distance from the axis x of rotation. It is to be noted that the varying height h can be provided in an advantageous manner since the separating disks 20 are manufactured in a press method and pressed against a tool part with a corresponding shape. The tool part can thus have projections and depressions, respectively, which are configured for the formation of the protrusions, and which have been given a varying height h in accordance with the applied press method in connection with the tool manufacturing.

The press method also makes it possible in an easy manner to let the extension of the protrusions 31, 32 be straight and radial or substantially radial, straight but inclined in relation to a radial direction, or curved at least if the protrusions 31, 32 are seen in the direction of the axis x of rotation. In the first embodiment the extension of the protrusions 31, 32 extends from in the proximity of the inner edge 24 to in the proximity of the outer edge 23.

The press method also makes it possible to configure the distance members 25, i.e. the first and second protrusions 31, 32, with a width at the inner surface and/or the outer surface 21 seen in a normal direction to the inner surface or the outer surface 21, wherein this width of at least some of the distance members 25 varies with the distance from the axis x of rotation.

Furthermore, the press method also enables the formation of stiffening folds or embossings (not disclosed) of the separating disks 20. Such folds may be straight or curved or extend in suitable directions.

Each of the first and second protrusions 31 and 32 comprises at least one contact zone 33 intended to abut the inner surface 22 and the outer surface 21, respectively, of an adjacent separating disk 20 in the disk package 19. As can be seen in FIG. 5, the contact zone 33 has a continuously convex shape seen in a cross section, in the first embodiment in a cross section transversally to a substantially radial direction. In the first embodiment, the contact zone 33 extends along the whole, or substantially the whole, extension of the first and second protrusions 31 and 32. With such a continuously convex shape of the contact zone 33 a small contact area between the contact zone 33 and the adjacent separating disk 20 is ensured, i.e. the contact area approaches zero. The contact zone 33 may in the first embodiment be defined to form a line abutment, or substantially a line abutment, against the inner surface 22 and the outer surface 21 respectively, of the adjacent separating disk 20 along the whole extension of the protrusions 31 and 32.

As can be seen in FIGS. 2 and 5, the separating disks 20 comprise first separating disk 20' and second separating disks 20". The first separating disks 20' comprise the first and second protrusions 31 and 32 which have been described above. The second separating disks 20" lack such protrusions, i.e. they comprise, or consist of, only one of the above mentioned portion without distance members 25. The second separating disks 20" thus have an even, or substantially even, tapering shape. The first and second separating disks 20' and 20" are provided in an alternating order in the disk package 19, i.e. every second separating disk 20 is a first separating disk 20' and every second separating disk is a second separating disk 20".

As can be seen in FIG. 3, each separating disk 20 comprises one or several recesses 35 along the inner edge 24. Such recesses may have the purpose of enabling a polar-positioning of the separating disks 20 in the disk package 19. Furthermore, each separating disk 20 comprises one or several recesses 36 along the outer edge 23. The recesses 36 may have the purpose of permitting transport of the medium through the disk package 19 and feeding of the medium into the different interspaces 26. It is to be noted that the recesses 35 and 36 may be advantageous for reducing the inherent stresses in the material in the pressed separating disk 20. The recesses 36 may be replaced by holes which in a manner known per se extend through the separating disk 20 and are provided at a distance from the inner and the outer edges 24, 23.

The separating disks 20 are polar-positioned in such a way that the first protrusions 31 of the first separating disks 20' are in line with each other in the disk package 19 seen in the direction of the axis x of rotation, see FIG. 5. Such a configuration of the disk package 19 is advantageous since it makes it possible to include a pre-tensioning in the disk package 19 when it is mounted. The second separating disks 20" will during the compressing of the disk package 19 be deformed elastically alternately upwardly and downwardly by the first and second protrusions 31 and 32 of the adjacent separating disks 20'. During operation of the centrifugal separator, forces arise in the second separating disks 20", which forces strive to straighten out the elastic deformation. Consequently, the abutment force between the separating disks 20 in the disk package 19 increases. In the embodiment disclosed, the first and second separating disks 20' and 20" have the same thickness t. However, it is to be noted that the first and second separating disks 20' and 20" may have different thicknesses t. Especially, the second separating disks 20", which lack protrusions, may have a thickness t which is significantly smaller than the thickness t of the first separating disks 20'. It is also to be noted that the height h of each distance member 25 of a first separating disk 20' varies in such a way that it compensates for the varying thickness t of the first separating disk 20' and for the varying thickness t of an adjacent second separating disk 20".

Figure 6:
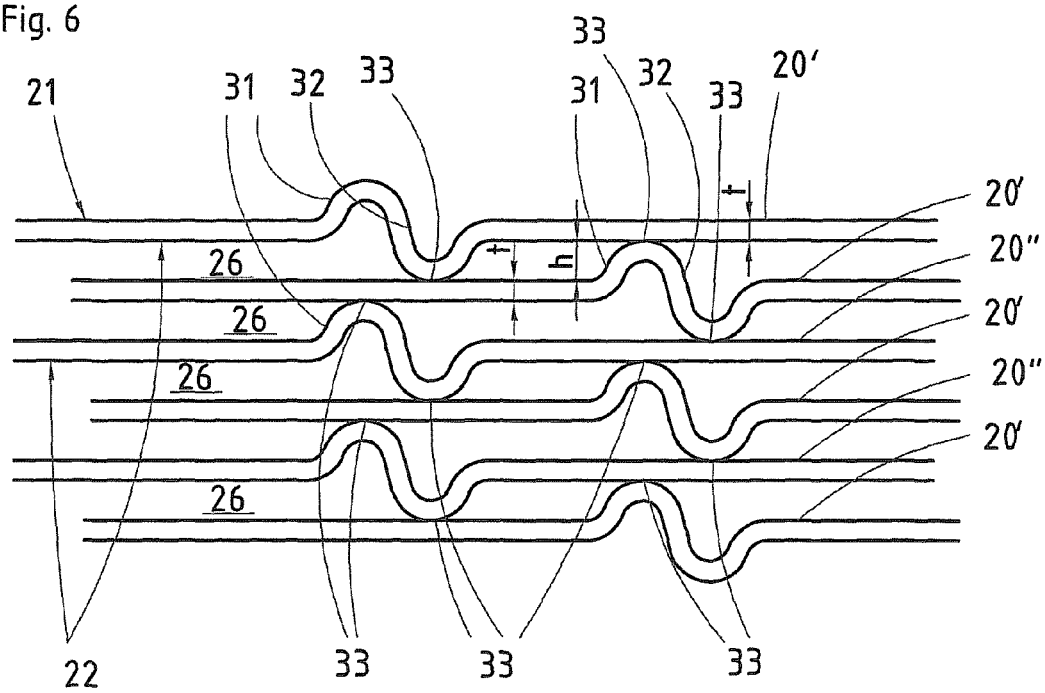
FIG. 6 discloses a section similar to the one in FIG. 5 of a part of a disk package according to a second embodiment.

According to a second embodiment of the disk package 19, see FIG. 6, also each second separating disk 20" may comprise a number of distance members in the form of pressed first and second protrusions 31 and 32, i.e. all separating disks 20 are provided with first and second protrusions 31 and 32. In this case, the separating disks 20 mat be polar-positioned in such a way that a first protrusions 31 of the first separating disks 20' are displaced in relation to the first protrusions 31 of the second separating disks 20" in the disk package 19 seen in the direction of the axis x of rotation.

According to a variant of the invention, the second separating disks 20" or the portions without distance members of the separating disks 20 may be provided with plastically deformed portions where the contact zone 33 of a first and/or second protrusion 31, 32 abuts or is intended to abut. The height of these plastically deformed portions is significantly lower than the height of the first and second protrusions 31, 32. In such a way a secure positioning of the separating disks 20 in relation to each other is created.

It is to be noted here that for achieving the above mentioned pre-tensioning in the disk package 19, it is possible to provide the disk package 19 with distance members 25 which can not be deformed and for instance be formed by conventional distance members which are brazed or welded to the separating disks 20, but which are located in a corresponding manner as the first and second protrusions 31 and 32. Such conventional distance members may also have a continuously convex contact zone as has been described above.

Figure 7:
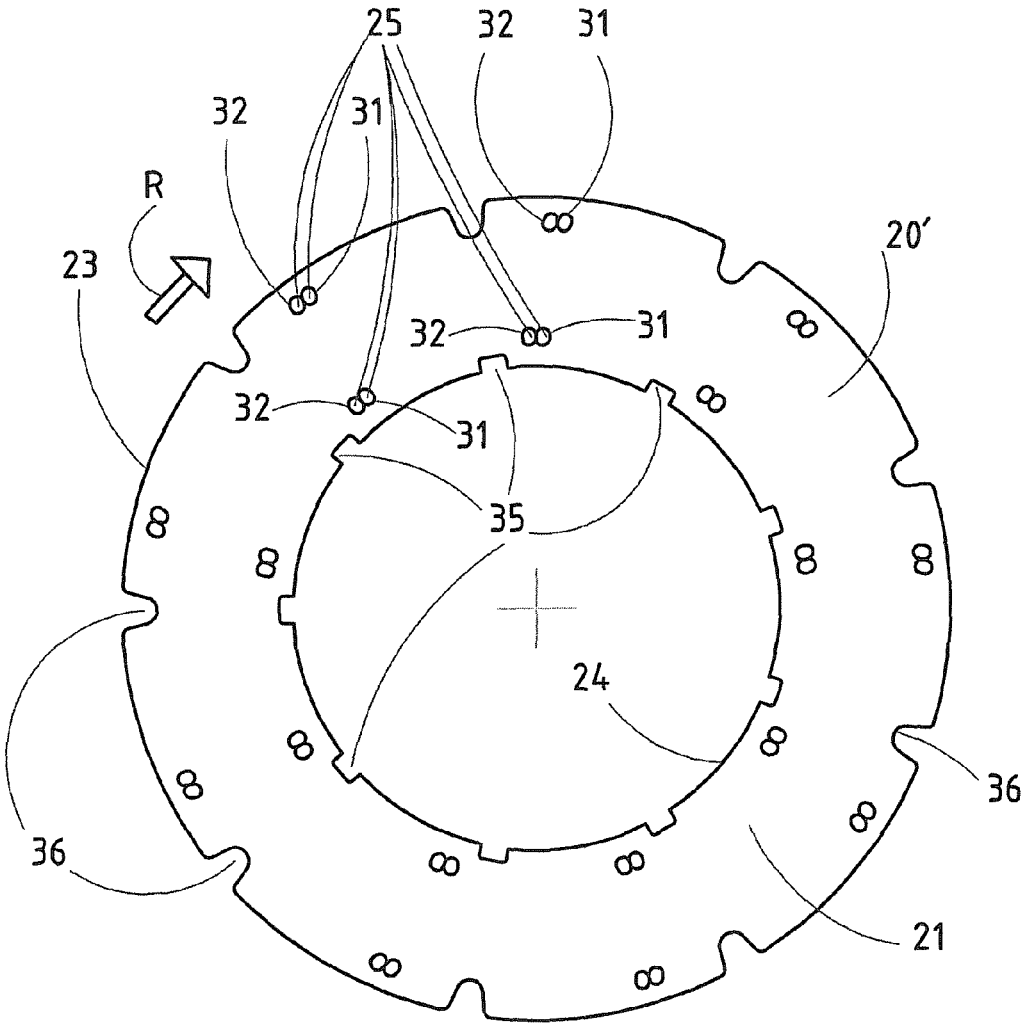
FIG. 7 discloses a view similar to the one in FIG. 3 of a separating disk according to a third embodiment.

FIG. 7 discloses a third embodiment where the distance members 25 have a spot-like extension. Also in this embodiment, the height of the distance members 25 may vary with the distance of the spot-like distance members 25 from the axis x of rotation. These distance members 25 may advantageously also be configured as first protrusions 31 extending away from the outer surface 21 and second protrusions 32 extending away from the inner surface 22. Each protrusion 31, 32 may advantageously have a continuously convex shape seen in a section transversally to a peripheral direction and transversally to a radial direction. In this embodiment, the contact zone 33 may be defined to form a point abutment, or substantially a point abutment, against the inner surface 22 or the outer surface 21 of the adjacent separating disk 20. The protrusions 31 and 32 are displaced in relation to each other and may be provided at a distance from or adjacent to each other. Moreover, it is to mentioned here that the separating disks 20 according to a further alternative may comprise both spot-like distance members 25 and elongated distance members 25.

Figure 8:
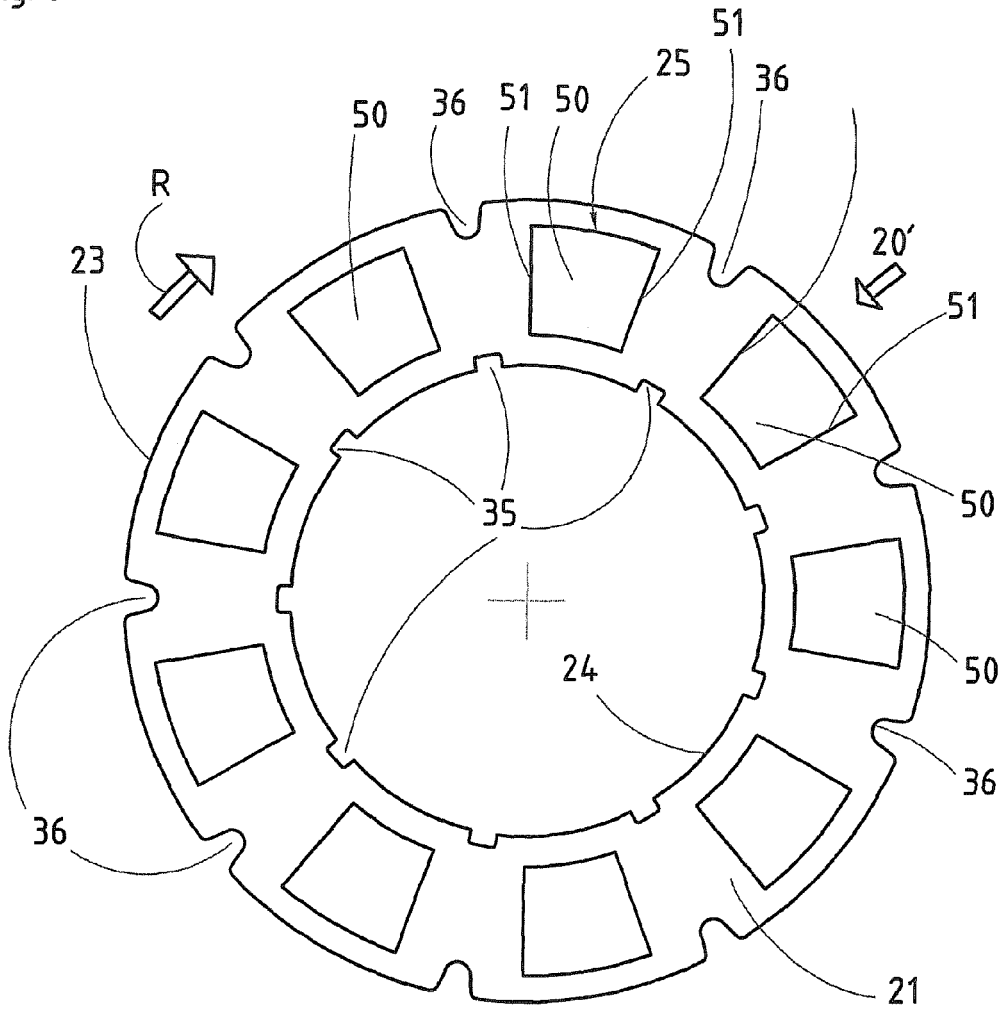
FIG. 8 discloses a view similar to the one in FIG. 3 of a separating disk according to a forth embodiment.
Figure 9:
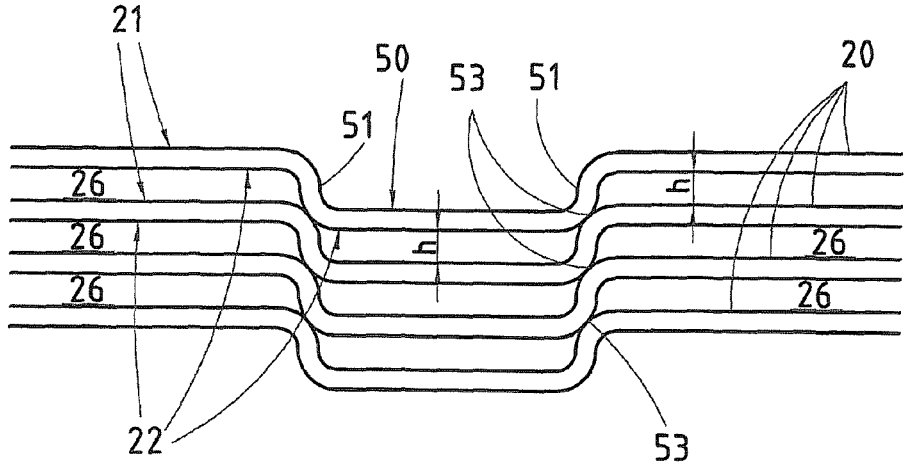
FIG. 9 discloses a section similar to the one in FIG. 5 through a disk package with separating disks according to the forth embodiment.

FIGS. 8 and 9 disclose a fourth embodiment of a pressed separating disk 20, where the distance members 25 are formed by protrusions 50 which all extends in the same direction away from the outer surface 21. Each protrusion 50 is delimited by two opposite side lines 51, which extend towards the outer edge 23 of the separating disk 20. In this embodiment, all separating disks 20, or substantially all separating disks 20, are identical. FIG. 9 discloses how the separating disks 20 are polar-positioned and abuts each other. In an area around each of the side lines 51, the protrusions 50 comprise a contact zone 53 on the outer surface 21 and a contact zone 53 on the inner surface 22. In the disk package 19, the contact zone 53 of a separating disk 20 abuts the contact zone 53 of an adjacent separating disk 20. Also here, each contact zone 53 has continuously convex shape seen in a cross section transversally to a substantially radial direction. The contact zones 53 extend along the whole, or substantially the whole, extension of the protrusions 50, and can be defined to form a line abutment, or substantially a line abutment, between the separating disks 20.

In the fourth embodiment, the protrusions 50 have substantially the same width as the areas between the protrusions 50. It is to be noted, however, that the width of the protrusions 50 also could be larger or smaller than the width of these areas. As can be seen FIG. 8, the protrusions 50 extend radially, or substantially radially from in the proximity of the inner edge 24 to in proximity of the outer edge 23. It is possible to let the protrusions 50 slope in relation to a radial direction and/or extend all the way to the inner edge 24 and/or all the way to the outer edge 23. Also according to the forth embodiment, it is possible to let the height of the protrusions 50 vary in order to compensates for a varying thickness of the pressed separating disk 20.

Figure 10:
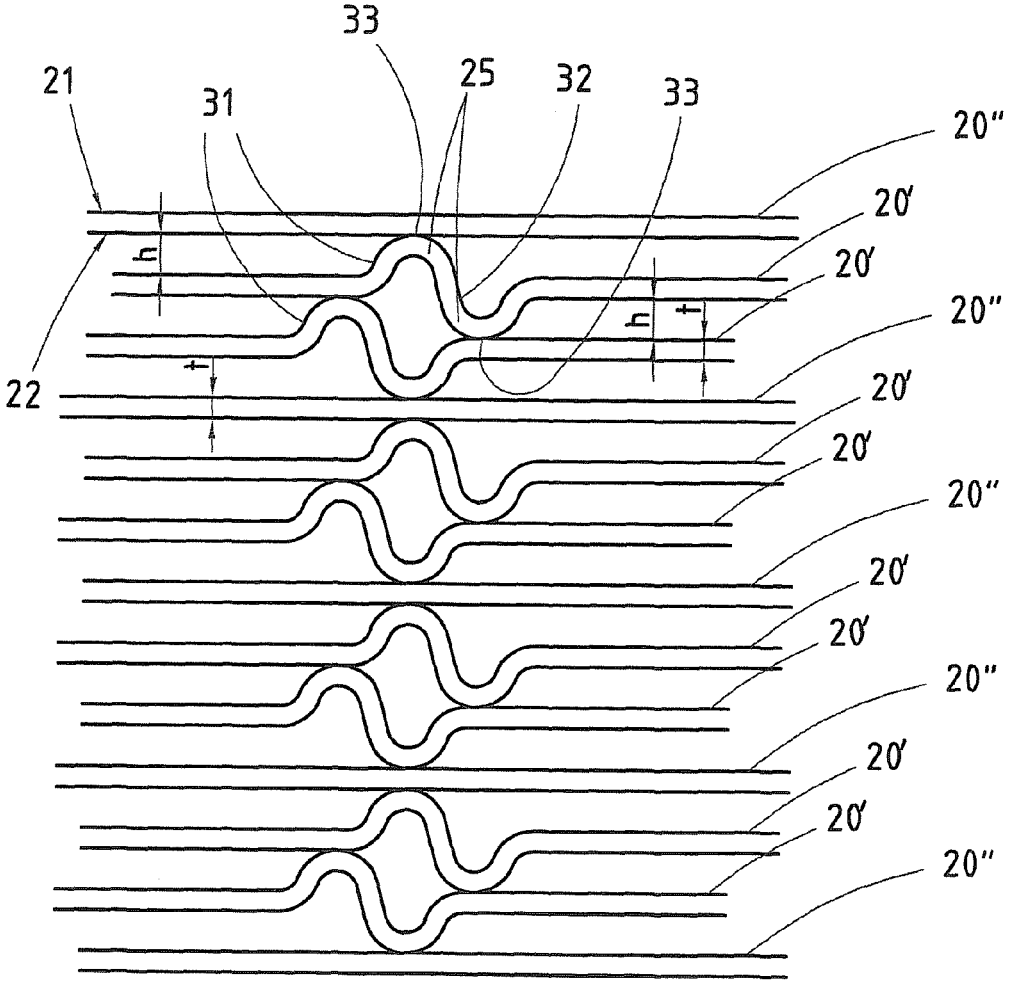
FIG. 10 discloses a section similar to the one in FIG. 5 through a disk package with separating disks according to a fifth embodiment.

It is to be understood that the polar-positioning of the separating disks 20 may be varied in many different ways in addition to the ways disclosed in FIGS. 5 and 6. FIG. 10 discloses a fifth embodiment where two first separating disks 20' are provided beside each other and each such pair of first separating disks 20' are separated by a second separating disk 20". The first protrusion 31 of a first separating disk 20' in such a pair lies opposite to the second protrusion 32 of the second first separating disk 20' in this pair, and opposite the first protrusions 31 of corresponding disks 20' in the remaining pairs.

Figure 11:
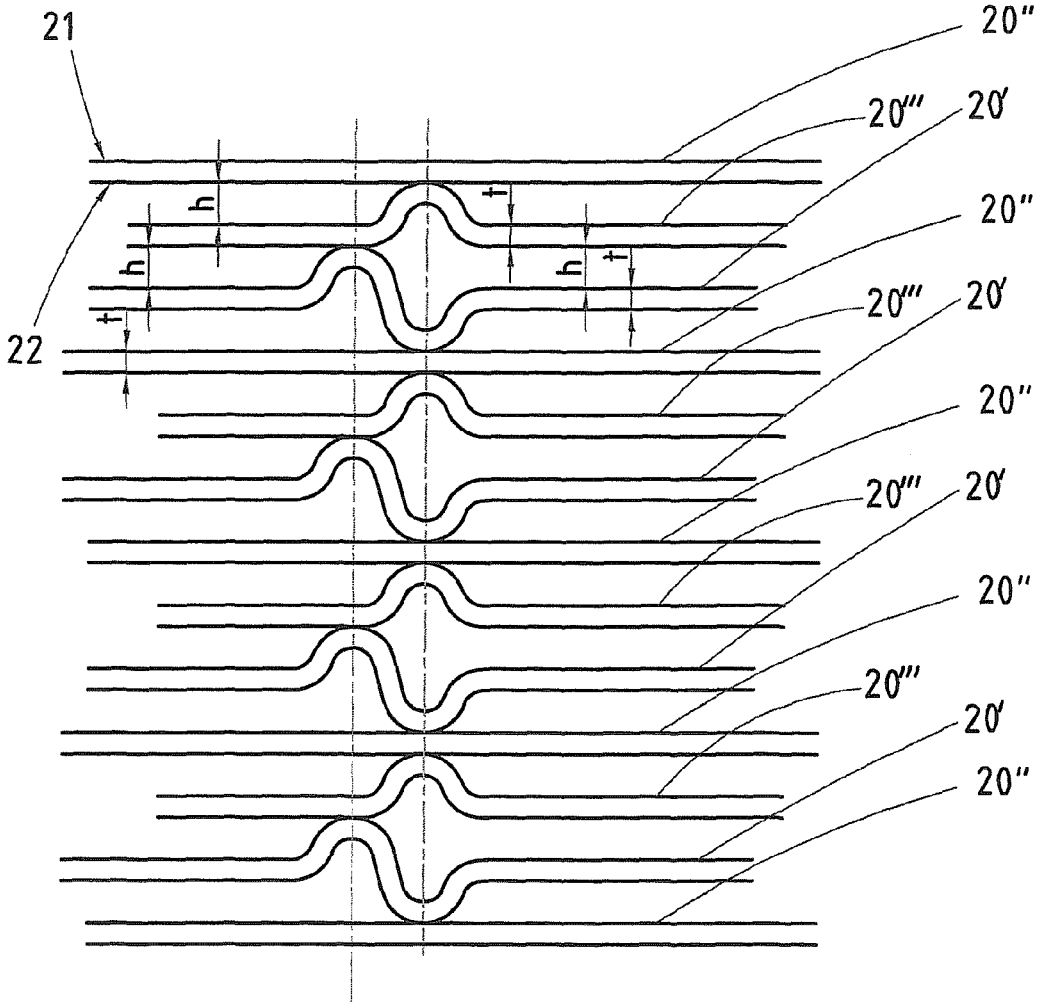
FIG. 11 discloses a section similar to the one in FIG. 5 through a disk package with separating disks according to a sixth embodiment.

FIG. 11 discloses a sixth embodiment which is similar to the fifth embodiment, but differs from the latter since one of the first separating disks 20' has been modified and is a third separating disk 20''' which comprises a first protrusion 31 but no second protrusion 32. The first protrusion 31 of the third separating disk in each pair lies opposite to the second protrusion 32 of the first separating disk 20' in each pair. In the fifth embodiment, a space which is closed in a cross-section is formed. Thanks to the absence of the second protrusion 32 of the third separating disk 20''', a lateral opening into this space is formed. It may also be mentioned that this closed space disclosed in FIG. 10 may be open at the ends through a variation of the length of the protrusions along their extension.

FIGS. 12 to 15 disclose of a press tool for manufacturing of a separating disk as defined above. The press tool is intended to be introduced in a press (not disclosed) of a suitable design. The press tool comprises a first tool part 61 and a second tool part 62. The first tool part 61 has a concave shape against which the outer surface 21 of the separating disk 20 abuts after finished pressing. The first tool part 61 has a surrounding tapering side surface, in the example disclosed a surrounding substantially conical side surface. The first tool part 61 thus has a shape corresponding to the tapering shape of the pressed separating disk 20. In the case that the separating disk 20 is provided with protrusions 31, 32, 50, the first tool part 61 also comprises first form elements 63, which are located on the surrounding tapering side surface and which correspond to the shape of these protrusions, in the disclosed press tool, the protrusions 31 and 32. The press tool comprises or is associated with a holding member 64 which is arranged to hold the blank to be pressed against the first tool part 61 with a holding force. If the separating disk 20 lacks protrusions, a first part tool 61 without first form elements 63 is used.

The second tool part 62 has a projecting central portion 80 arranged to extend through and engage a central opening of the blank 90 to be pressed. By means of this central portion 80, the blank 90 may be positioned in the press tool before pressing. The first and second tool parts 61 and 62 furthermore have a respective form element 81 and 82, respectively, which in co-operation with each other are arranged to form, when the first and second tool parts 61, 62 are moved towards each other, an area around the central opening in such a way that the material in this area forms a centering member 91 extending cylindrically, or at least partly cylindrically, and concentrically with the axis x of rotation, see FIG. 14. The second tool part 62 also comprises a sealing element 83, which is provided radially outside the projecting central portion 80. The sealing element 83 extends around the central portion at a distance from the latter. The sealing element 83 is arranged to abut sealingly the blank 90 around the central opening. The total press force is reduced thanks to the fact that the centre of the blank 90 inside the sealing element 83 has been masked and thus is not subjected to any pressing. The central portion 80, which positions the blank 90, will also permit guiding of the flow of material in the blank 90 in an initial stage of the pressing with regard to how much material is transported from the centre of the blank 90 and from the peripheral parts of the blank 90. The guiding of the flow of material can be provided by varying the size of the central opening and/or by varying the holding force.

Furthermore, the press tool comprises a supply device arranged to permit supply of a liquid at a pressure between the blank 90 and the second tool part 62. The supply device comprises channels 65 extending through the second tool part 62 through the surface of the second tool part 62 facing the blank 90.

Furthermore, the first tool part 61 comprises a plurality of evacuating passages 67 for evacuating gas present between the blank 90 and the first tool part 61. The evacuating passages 67 have a very small flow area and are provided to extend through the bottom surface and the surrounding tapering side surface of the first tool part 61. Especially, it is important that there are evacuating passages 67 which extend through these surfaces at the first form elements 63 forming the first and second protrusions 31, 32, and at the second form elements 66 forming the centering member.

The press tool is arranged to permit, in a charging position, introduction of the blank 90 to be pressed between the first tool part 61 and the second tool part 62 in such a way that the projecting central portion extends through the central opening. Thereafter, the blank 90 is clamped between the first tool part 61 and the holding member 64, see FIG. 12. The first tool part 61 and/or the second tool part 62 are then displaced in a first part step in a direction towards each other to a final position, see FIG. 13. The first part step can be regarded as a mechanical press step. Thereafter, a liquid at a pressure is supplied in a second part step into a space between the blank 90 and the second tool part 62 through the channels 65 in such a way that the blank 90 is pressed to abutment against the first tool part 61 and takes its final shape, see FIG. 14. The sealing element 83 then prevents the liquid from reaching the central opening. During the second part step, the gas present between the blank 90 and the first tool part 61 will be evacuated via the evacuating passages 67. The second part step can be regarded as a hydroforming step.

After the pressing, the blank 90 is removed from the press tool and transferred to any suitable processing machine (not disclosed). The blank 90 is centered in the processing machine by means of the centering member or members. The processing machine is then arranged to form, in a subsequent processing step, the inner edge 24 and the outer edge 23 of the separating disk 20.

This subsequent processing step comprises forming of the above mentioned one or several recesses 35 along the inner edge 24 and the above mentioned one or several recesses 36 along the outer edge 23. The subsequent processing step may comprise any suitable cutting or shearing operation.

It is to be noted that the first tool part 61 instead of a concave shape may have a convex shape, wherein the inner surface 22 of the separating disk 20 will abut the first tool part 61 after finished pressing.

It is to be noted that the separating disks 20 may be provided with a certain surface roughness on the outer surface and/or the inner surface. Such a surface roughness can be provided through a treatment in advance of the whole, or a part or parts of the outer surface 21 and/or the inner surface 22, for instance in that the actual surface is etched before the separating disk is pressed. The surface roughness will remain after the pressing. It is also imaginable to configure one or both tool parts 61, 62 with a surface roughness, wherein the pressing will provide the desired surface roughness of the actual surface of the outer surface and/or inner surface of the separating disk. Suitable examples of the surface roughness is disclosed in SE-B-457612. The roughness may thus comprise a plurality of flow influencing members having a certain height over the actual surface and a certain mutual distance. The relation between the certain height and the certain distance may lie in the interval 0,2-0,5. As indicated above, it is possible to provide selected parts with a roughness. Different parts of the actual surface may also have different roughness. Advantageously, only one of the outer surface 21 and the inner surface 22 is provided with a roughness. The protrusions 31, 32 suitably have no roughness as well as the surface portions against which the protrusions 31, 32 abut.

Figure 12:
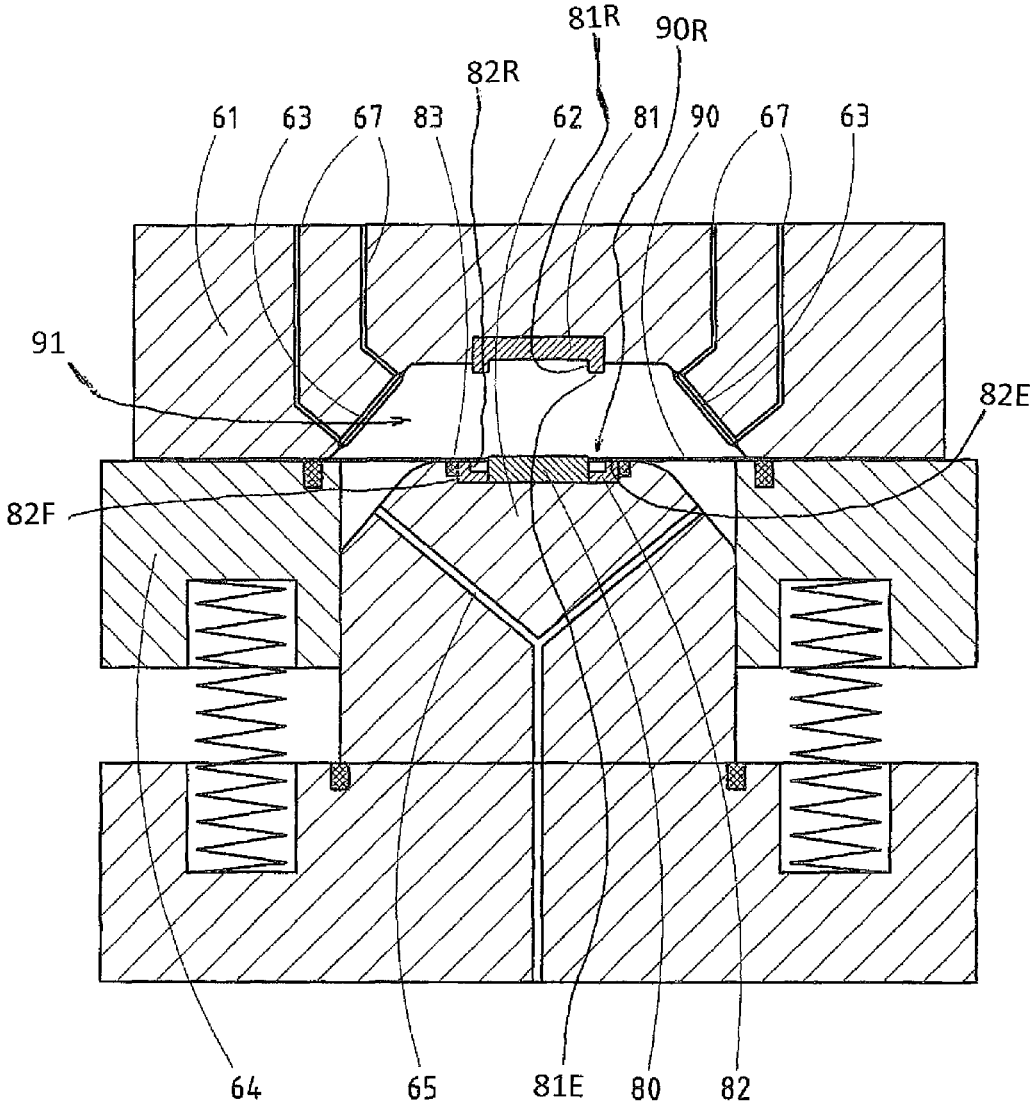
FIG. 12-14 discloses a sectional view of a press tool for pressing a separating disk.
Figure 14:
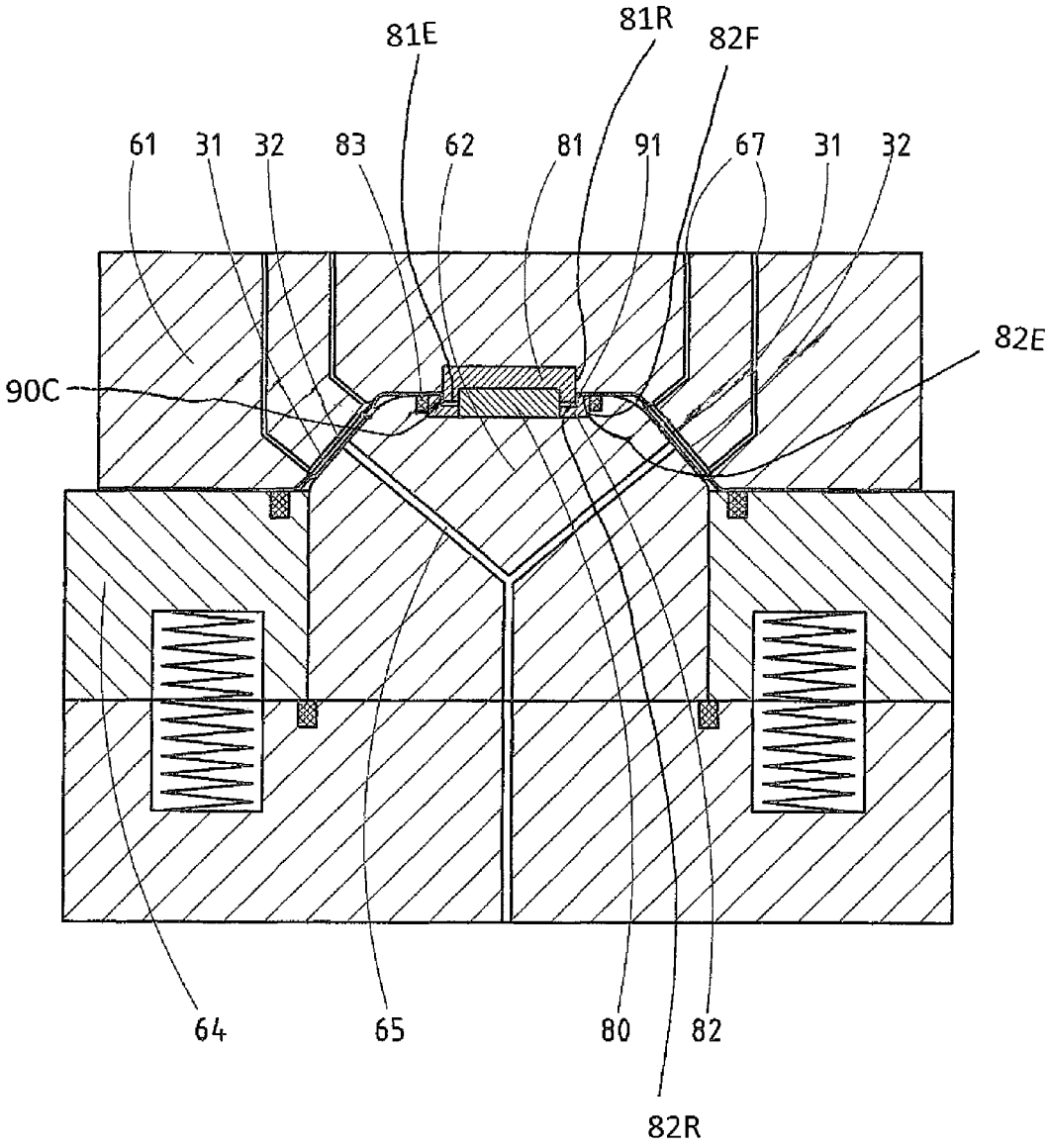

Referring to FIG. 12, the first tool part 61 and the second tool part 64 of the press tool for manufacturing the separating disk 20 (as shown in FIGS. 3 and 4) are shown in a charging position in which the first tool part 61 and the second tool part 64 are separated from one another for receiving the blank 90 of material therebetween. The first tool part 61 has a shape corresponding to a tapering shape of the separating disk 20 and the second tool part 64 has a projecting central portion 80 for extending through a central opening 90C of the blank 90 for positioning the blank 90 in the charging position. The first tool part 61 and the second tool part 64 are moveable against each other to a final position as shown in FIG. 14, in which the first tool part 61 and the second tool part 64 are pressed against one another for compressing the blank 90 therebetween. The first tool part 61 has a first form element 81 positioned therein. The first form element 81 extends peripherally therefrom in a first direction toward the second tool part 64 and terminates at a first edge 61E The first form element 81 defines a first radially outward facing surface 81R. The second tool part 64 has a second form element 82 extending peripherally therefrom in a second direction towards the first form element 61 and terminates at a second edge 64E. The second form element 82 is positioned coaxially with the first form element 61. The second form element 82 has a radially inward facing surface 82R. The radially inward facing surface 82R and the first radially outward facing surface 81R having complementary shapes. In the charging position illustrated in FIG. 12, the first edge 81E and second edge 82E are spaced apart from one another sufficient to receive a radially inner portion 90R of the blank 90. In the final position illustrated in FIG. 14, the first edge 81E extends into the second form element 82 such that the radially inward facing surface 82R and the first radially outward facing surface 81R are spaced apart from one another for causing the radially inner portion 90R of the blank to extend axially, thereby forming a centering member 90C on the blank 90 as shown in FIG. 14.

In one embodiment, the second tool part 62 has a sealing element 83 positioned outward from and surrounding a second radially outward facing surface 82F defined by the second form element 82. In the final position as illustrated in FIG. 14, the sealing element 83 is abuts a portion of the blank 90 proximate to the radially inner portion 90R of the blank 90.

As illustrated in FIG. 12, in one embodiment, the press tool includes a fluid supply device 65 in communication with a space 91 defined between the first tool part 61 and the second tool part 64 for supplying a pressurized fluid between the blank 90 and the second tool part 64 for pressing the blank 90 against the first tool part 61.

Figure 15:
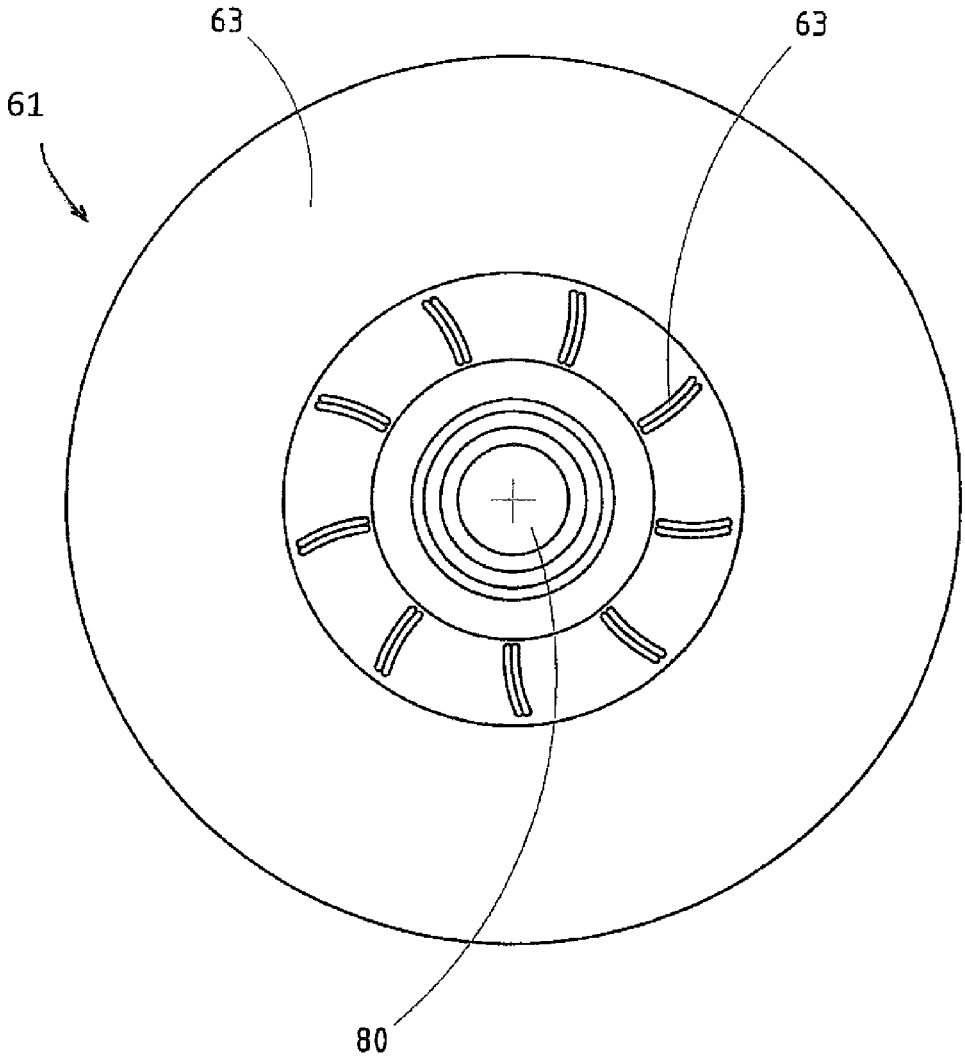
FIG. 15 discloses a plan view of a tool part of the press tool in FIGS. 12-14.

As illustrated in FIG. 15, in one embodiment the first tool part 61 includes a plurality of form element 63 configured to form a plurality of distance members 25 on the blank 90 as shown in FIG. 3. The form elements 63 are further configured to form the at least one distance member 25 into pressed protrusions 31, 32 extending away from the blank 90, as shown in FIG. 7.

Figure 13:
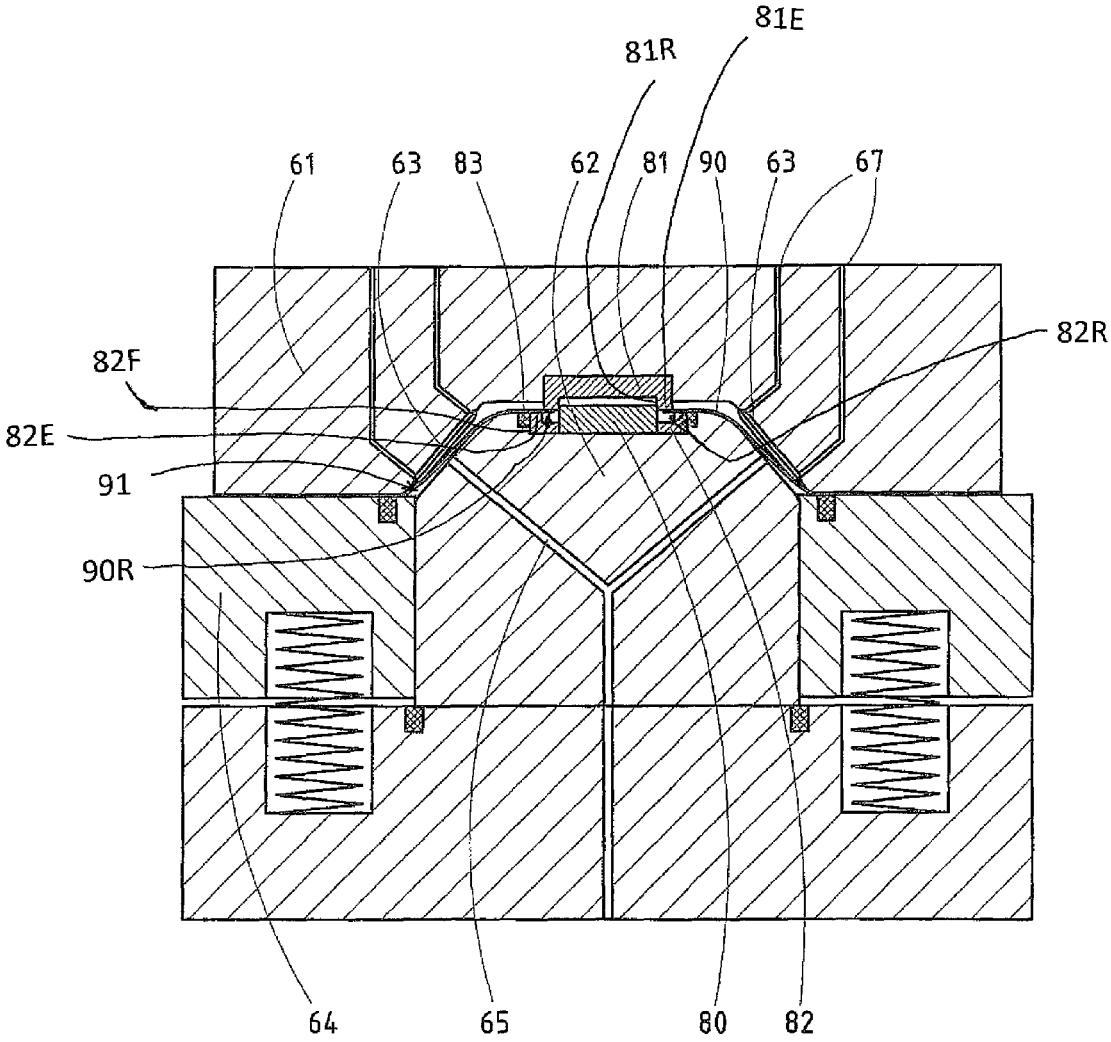

As illustrated in FIGS. 12-14, the first tool part 61 includes evacuating passages 67 extending therethrough for evacuation of a gas present between the blank 90 and the first tool part 61.

The invention is not limited to the embodiments disclosed but may be varied and modified within the scope of the following claims. Especially, it is to be noted that the described separating disks may be used in substantially all kinds of centrifugal separators, for instance such where the centrifuge rotor has fixed openings for radial discharge of sludge, or intermittently openable such openings, see FIG. 1. The invention is applicable to centrifugal separators adapted for separation of all kinds of media, such as liquids and gases, for instance separating of solid or liquid particles from a gas.

The invention claimed is:

1. A method for manufacturing a separating disk adapted to be included in a disk package of a centrifuge rotor of a centrifugal separator, wherein the separating disk extends around an axis (x) of rotation and has a tapering shape with an inner surface and an outer surface along the axis (x) of rotation, the method including:

providing a blank of a material, making an central opening in the blank, positioning the blank in a charging position between a first tool part and a second tool part of a press tool, the first tool part and the second tool part being separated from one another by means of a projecting central portion provided on the second tool part, and pressing of the blank against the first tool part which has a shape corresponding to the tapering shape of the separating disk;

the pressing step comprises forming of an area around the central opening in such a way that the material in the area around the central opening forms a centering member, which at least partly extends cylindrically and concentrically with the axis (x) of rotation; and the pressing step comprises a first part step where the blank by means of the second tool part is pressed in a direction towards the first tool part in such a way that said centering member is formed and that a sealing element of the second tool part abuts the blank around the central opening.

2. A method according to claim 1, wherein the projecting central portion extends through and engages the central opening of the blank.

3. A method according to claim 1, wherein the press step also comprises a second part step where a liquid is supplied at a pressure between the blank and the second tool part in such a way that the blank is pressed to abutment against the first tool part.

4. A method according to claim 3, wherein the second part step comprises evacuation of gas present between the blank and the first tool part.

5. A method according to claim 1, wherein the pressing step comprises forming of a plurality of protrusions which extends from the inner surface and/or the outer surface, wherein the first tool part comprises first form elements having a shape corresponding to the shape of the protrusions.

6. A method according to claim 1, wherein the method comprises at least a subsequent processing step for forming of an inner edge, delimiting a central opening of the separating disk, and an outer edge.

7. A method according to claim 6, wherein the processing step is preceded by a centering of the separating disk by means of said centering member in a processing machine before the processing step is performed.

8. A method according to claim 6, wherein the processing step comprises forming of one or several recesses along the inner edge.

9. A method according to claim 6, wherein the processing step comprises forming of one or several recesses along the outer edge.

10. A method according to claim 6, wherein said recess is arranged to permit polar-positioning of the separating disk in the disk package.

11. A method according to claim 1, wherein the first tool part has a concave shape against which the outer surface of the separating disk abuts.

12. A press tool for manufacturing a separating disk, the press tool comprising:

a first tool part and a second tool part, the first tool part and the second tool part defining a charging position in which the first tool part and the second tool part are separated from one another for receiving a blank of material therebetween;

the first tool part and the second tool part are moveable against each other to a final position in which the first tool part and the second tool part are pressed against one another for compressing the blank therebetween, the first tool part has a shape corresponding to a tapering shape of the separating disk and the second tool part has a projecting central portion for extending through a central opening of the blank for positioning the blank in the charging position; and the first tool part having a first form element positioned therein, the first form element extending peripherally therefrom in a first direction toward the second tool part and terminating at a first edge, the first form element defining a first radially outward facing surface;

the second tool part having a second form element extending peripherally therefrom in a second direction towards the first form element and terminating at a second edge, the second form element being positioned coaxially with the first form element and the second form element having a radially inward facing surface;

the radially inward facing surface and the first radially outward facing surface having complementary shapes;

in the charging position, the first edge and second edge are spaced apart from one another sufficient to receive a radially inner portion of the blank; and in the final position, the first edge extends into the second form element such that the radially inward facing surface and the first radially outward facing surface are spaced apart from one another for causing the radially inner portion of the blank to extend axially, thereby forming a centering member on the blank.

13. A press tool according to claim 12, wherein the second tool part has a sealing element positioned outward from and surrounding a second radially outward facing surface defined by the second form element, wherein in the final position the sealing element is positioned for abutting a portion of the blank proximate to the radially inner portion of the blank.

14. A press tool according to claim 12, further comprising a fluid supply device in communication with a space defined between the first tool part and the second tool part for supplying a pressurized fluid between the blank and the second tool part for pressing the blank against the first tool part.

15. A press tool according to claim 12, wherein the first tool part comprises at least one third form element configured to form at least one distance member on the blank the at least one third form element further configured to form the at least one distance member into pressed protrusions extending away from the blank.

16. A press tool according to claim 12, wherein the first tool part comprises evacuating passages extending therethrough for evacuation of a gas present between the blank and the first tool part.

* * * * *